US005873379A

United States Patent [19]

Bouix

[11] Patent Number: 5,873,379

[45] Date of Patent: Feb. 23, 1999

[54] MASS RETENTION DEVICE WITH BELLOWS

[75] Inventor: Herve F. Bouix, New York, N.Y.

[73] Assignee: Color Access, Inc., Melville, N.Y.

[21] Appl. No.: 72,215

[22] Filed: May 4, 1998

[51] Int. Cl.[6] ..... A45D 40/24

[52] U.S. Cl. ..... 132/318; 132/320; 401/78; 401/87

[58] Field of Search ..... 132/318, 320; 401/109, 59, 78, 98, 192, 80, 74, 87, 141, 145, 148, 176, 265, 266

[56] References Cited

U.S. PATENT DOCUMENTS

| | | |
|---|---|---|
| 636,454 | 11/1899 | Rubira . |
| 3,175,680 | 3/1965 | Fuglsang-Madsen et al. . |
| 4,579,134 | 4/1986 | Moore . |
| 4,820,070 | 4/1989 | Spatz . |
| 5,560,727 | 10/1996 | Vaupel . |

FOREIGN PATENT DOCUMENTS

| | | |
|---|---|---|
| 3319031 | 11/1984 | Germany . |
| 731013 | 6/1955 | United Kingdom . |
| WO 96/32031 | 10/1996 | WIPO . |

*Primary Examiner*—Gene Mancene
*Assistant Examiner*—Philogene Pedro
*Attorney, Agent, or Firm*—Kenyon & Kenyon

[57] ABSTRACT

The present invention is a case for a stick product that prevents the release of the stick product from the holder cup the case comprises an inner sleeve having a wall and a longitudinal track within the wall. The longitudinal track has a first upper lateral segment and a second upper lateral segment, said first upper lateral segment having a ramp. An outer sleeve is fitted about the inner sleeve so as to be able to rotate with respect to the inner sleeve, said outer sleeve having an inner wall, an outer wall, and a helical track along the inner wall. A holder cup is fitted into the inner sleeve. The holder cup comprises a shell having an inner surface and an outer surface. A lug is attached to the outer surface and extends through the longitudinal track to engage the helical track. A bellows portion is located below the lug and comprises part of the shell of the holder cup, said bellows capable of occupying a first stretched position and a second contracted position. When the bellows is in the stretched position, the stick product can be easily inserted into the holder cup without damaging the stick itself. In the contracted position, the bellows forms ridges which grip and penetrate the stick product, thus holding the product in place.

19 Claims, 4 Drawing Sheets

MASS RETENTION DEVICE WITH BELLOWS

FIELD OF THE INVENTION

The present invention relates to a stick product case that prevents the release of the stick product from the holder cup. More particularly, it concerns a holder cup which locks the stick product in place to prevent release of the stick product from the holder cup upon a shock to the case or upon shrinkage of the stick product itself.

BACKGROUND OF THE INVENTION

Generally, when lipsticks are manufactured, the cases are assembled separately from the molding of the lipstick product itself. After the assembly of the case and the molding of the stick, the holder cup is placed in the advanced position, ready to receive the lipstick product. Then the lipstick product is placed within the holder cup of the case, the holder cup is moved into the retracted position, a cover is placed on the case, and the case is ready for sale to a consumer The means by which the stick product is held in the cup is usually via a friction fit between the stick product and the inner wall of the holder cup. These two elements, the holder cup and the stick product, are dimensioned so that a proper friction fit is obtained. The problem with this means of holding the stick product in the holder cup is that, over time, the dimensions of the stick product often will change due to a number of different causes. For example, the dimensions of stick products change due to the method of cooling of the product after molding or filling into the holder cup whereby the cooling causes product to shrink.

Also, with the increasing use of volatile ingredients within the formulations for stick products, shrinkage problems are a concern. These volatile ingredients tend to evaporate, which then causes the product to shrink, thereby causing the friction fit between the cup and the product to be insufficient to hold the product in place during a shock to the case. In either case, when this happens, a once proper fit between the holder cup and the product will no longer be sufficient to hold the product in place. Once shrinkage has occurred to the point where the fit between the holder cup and the product is insufficient to hold the product in place, a small shock to the case will cause the product to release. Once the product has released from the holder cup, it is virtually useless to the consumer.

Current holder cups try to remedy this problem in a number of different ways. Some cups provide a holder wall which protrudes from the bottom of the holder cup, so that when the stick product is inserted into the holder cup a greater surface area of contact between the product and the holder cup is provided (see DE Patent No. 3319031). Along the same premise of increasing the contact surface area, longitudinally extending internal ribs are added to the holder cup as disclosed in U.S. Pat. No. 3,175,680 and U.S. Pat. No. 4,579,134. U.S. Pat. No. 4,820,070, provides that the longitudinally extending internal ribs be a dove-tail design to further provide greater contact area and to hold the stick in place after shrinkage of the stick has occurred.

With the new formulations of stick products that contain a considerable amount of volatile ingredients, the frictional forces created by the above mentioned configurations of holder cups may not be sufficient to hold the product in place after shrinkage of the stick has occurred and then the case experiences a shock. Insufficient frictional force is available after the stick shrinks because the aforementioned holder cups all pre-form grooves within the stick product when the stick is inserted into the holder cup. The product then shrinks away from the pre-formed grooves, thereby lessening the contact surface and the frictional forces.

WO 9632031 provides for a holder cup that employs the use of a spike which penetrates a lipstick to hold the lipstick in place. This spike is either attached to a snap-ring or an arm. Both embodiments allow the spike to pass through an aperture in the holder cup, thereby puncturing a lipstick. This type of holder cup is effective in holding a stick product in place after shrinkage because a groove is not formed when the product is inserted into the holder cup. However, these embodiments require additional assembly or may be difficult to manufacture via known holder cup molding techniques.

U.S. Pat. No. 5,560,727 discloses the use of spring elements provided on the lipstick holder to aid in holding the lipstick mass in place. These spring elements are pressed into the lipstick to form rear-engaging lugs as the lipstick holder is retracted into the case. The disadvantage of this arrangement is that the rear-engaging lugs do not lock in place after they are pressed into the lipstick.

An alternative configuration holder cup is one which utilizes horizontal ribs in order to assist in securing the mass within the cup. This type of holder cup, however, also requires the use of new machinery and manufacturing methods. With the traditional method of manufacture for a longitudinal ribbed cup, the stick product is heated and poured into a mold of the desired shape. After the stick has cooled and sufficiently solidified, the stick is removed from the mold and placed within the holder cup of a pre-assembled case. When using a horizontal ribbed cup, instead of first filling the stick product within a separate mold, the stick is molded within the holder cup itself and then the case is assembled around the stick. This modified method of manufacture and assembly requires the enormous expense of the purchase of new machinery and the retraining of personnel. If, however, the stick was molded and subsequently inserted into a holder cup with horizontal ribs, assembly of the salable product would be impossible without destroying or substantially deforming the stick product. Moreover, after the stick is deformed by the horizontal ribs, a frictional force sufficient to hold the stick within the cup upon a shock to the case is not likely to be obtained.

The purpose of the present invention is to provide a stick product case which will secure the stick product in place when the case is exposed to a shock.

Another purpose of the present invention is to provide a stick product case that is simple to manufacture.

Another purpose of this invention is to provide a stick product case which will continue to hold a stick product in place even after the product changes its dimensions.

Further, it is a purpose of this invention to provide a stick product case which is a relatively simple device that avoids interference with package aesthetics.

SUMMARY OF THE INVENTION

The present invention is a case for a stick product that prevents the release of the stick product from the holder cup. The case comprises an inner sleeve having a wall and a longitudinal track within the wall. The longitudinal track has a first upper lateral segment and a second upper lateral segment, said first upper lateral segment having a ramp. An outer sleeve is fitted about the inner sleeve so as to be able to rotate with respect to the inner sleeve, said outer sleeve having an inner wall, an outer wall, and a helical track along the inner wall. A holder cup is fitted into the inner sleeve.

The holder cup comprises a shell having an inner surface and an outer surface. A lug is attached to the outer surface and extends through the longitudinal track to engage the helical track. A bellows portion is located below the lug and comprises part of the shell of the holder cup, said bellows capable of occupying a first stretched position and a second contracted position. When the bellows is in the stretched position, the stick product can be easily inserted into the holder cup without damaging the stick itself. In the contracted position, the bellows forms ridges which grip and penetrate the stick product, thus holding the product in place.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

For purposes of clarity, the present invention will be described as used in conjunction with a lipstick case. This example is merely illustrative, and in no way limits the present invention to lipstick. It will be apparent to one of ordinary skill in the art how the present disclosure can be adapted for use with any stick product, including, but not limited to, deodorants, lip balms, make-up foundations, clear cosmetic sticks, anti-acne sticks, concealers, sunscreen sticks, and the like.

In a typical lipstick case, in order to enable the holder cup to be moved between an advanced and a retracted position, the case is provided with an inner sleeve and an outer sleeve that rotate with respect to each other. The inner sleeve has a wall and a longitudinal track extending through the wall. The outer sleeve is placed about the inner sleeve so as to be able to rotate with respect to the inner sleeve. The outer sleeve has an inner wall, an outer wall, and a helical track which extends along a substantial length of the inner wall. The holder cup is fitted into the inner sleeve. The holder cup is provided with a pair of opposing lugs which extend through the longitudinal track of the inner sleeve to engage the helical groove of the outer sleeve. When the inner and outer sleeves are rotated, the lugs of the holder cup follow the path defined by the longitudinal track and the helical groove, thereby moving the holder cup between an advanced and a retracted position.

The longitudinal track of the inner sleeve is usually provided with an upper lateral segment and a lower lateral segment. The upper segment serves to retain the holder cup in the advanced position while the lipstick is being applied by the consumer, by providing a surface upon which the lugs of the holder cup can rest. If this surface was not provided, the force created during application of the product would cause the holder cup to travel down the longitudinal track and into the retracted position, thus making application difficult. Likewise, the lower segment provides a surface which serves to retain the holder cup in the retracted position. If this surface were not present, a shock to the case while the holder cup was in the retracted position would cause the holder cup to travel along the longitudinal track, thus causing the stick product to contact the inner surface of the cover of the case, thereby deforming the application surface of the lipstick.

Figure 1:
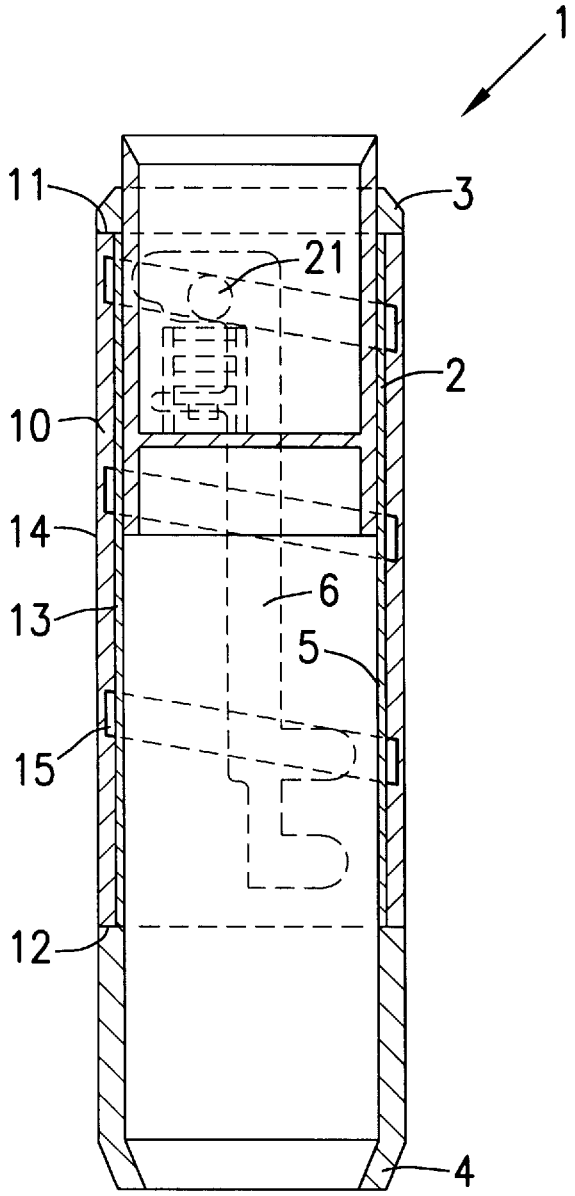
FIG. 1 is a cross-sectional view of the assembled case according to the present invention.

The case of the present invention retains these basic features, but is further modified to permit more efficient retention of the stick in the case. In brief, the present invention utilizes a flexible bellows to form ridges which grip the stick and hold it in place after insertion of the stick into the holder cup. Referring now to the drawings, FIG. 1 shows a lipstick case of the present invention. The lipstick case 1 comprises an inner sleeve 2 having an upper end 3 and a lower end 4, a wall 5, and a longitudinal track 6 extending through the wall 5 of the inner sleeve 2. An outer sleeve 10 is fitted about the inner sleeve 2 so as to be able to rotate with respect to the inner sleeve 2. The outer sleeve 10 has an upper end 11 and a lower end 12, an inner wall 13 and an outer wall 14, and a helical track 15 which preferably extends along a substantial length of the inner wall 13. A generally cylindrical holder cup 20, capable of holding a stick product such as a lipstick, is fitted into the inner sleeve 2, the holder cup 20 having opposing lugs 21 which extend through the longitudinal track 6 to engage the helical track 15, whereby the holder cup 20 is movable in an axial path between an advanced and a retracted position by the relative rotation of the inner sleeve 2 and the outer sleeve 10.

Figure 2B:
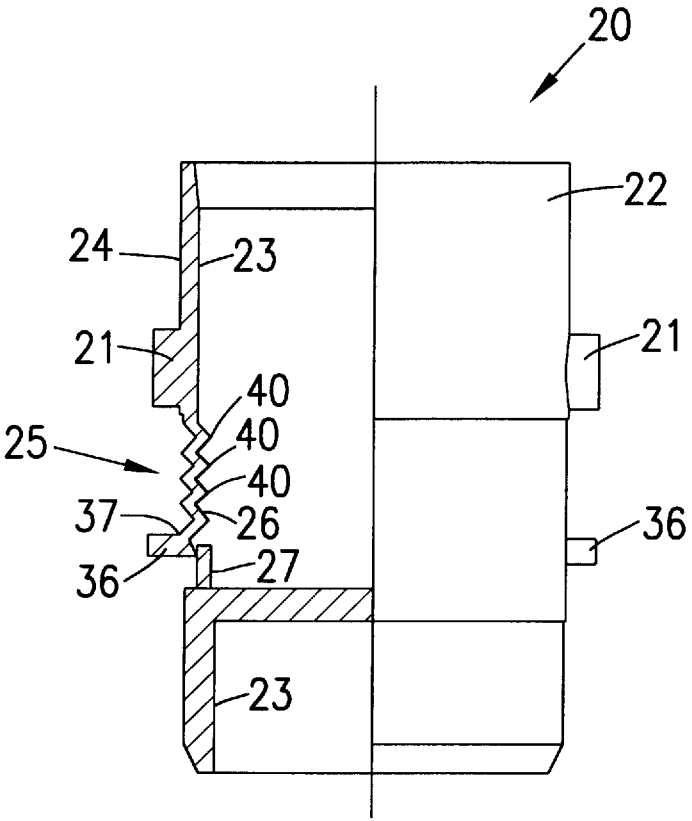
FIGS. 2A and 2B are partial cross-sectional views of the holder cup of the present invention in the advanced and retracted positions, respectively.
Figure 2A:
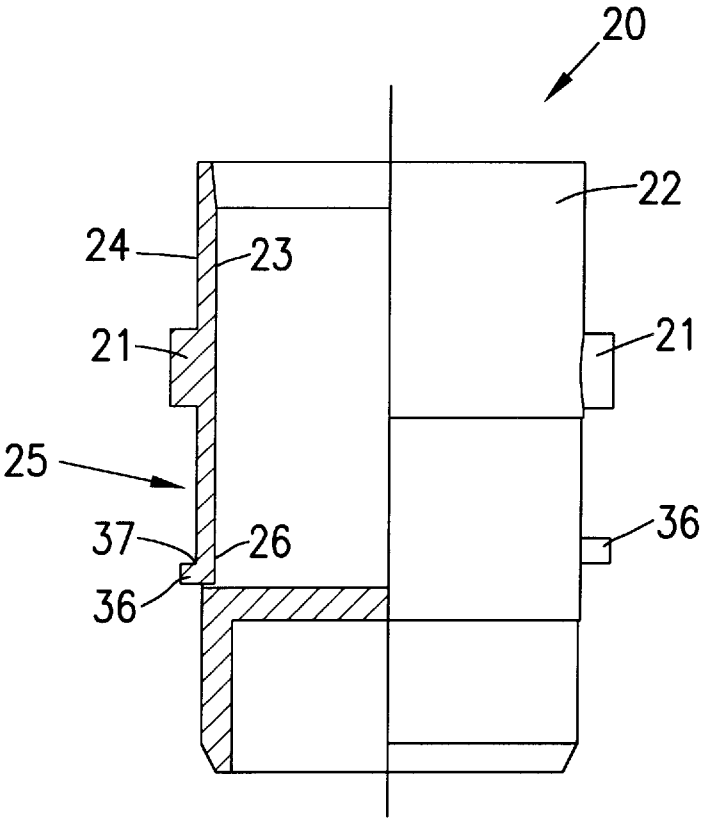

As seen in greater detail in FIGS. 2A and 2B, the holder cup 20 of the present invention comprises a shell 22 having an inner surface 23 and an outer surface 24. A set of two opposing lugs 21 are attached to the outer surface 24 of the shell 22 and extend through the longitudinal track 6 of the inner sleeve 2 to engage the helical track 15 of the outer sleeve 10. Additionally, the holder cup 20 has a flexible bellows portion 25 located below the lugs 21, said bellows portion 25 comprising part of the shell 22 of the holder cup 20. The bellows 25 is capable of occupying a first position (shown in FIG. 2A) corresponding to the advanced position of the holder cup 20, and a second position (shown in FIG. 2B) corresponding to the retracted position of the holder cup. In the first position, the bellows portion 25 is stretched so that the inner face 26 of the bellows 25 is substantially flattened and generally assumes the shape of the inner surface 23 of the cup 20. When the bellows 25 is stretched, a stick product can be easily inserted into the cup 20 without deforming or damaging the stick product. As shown in FIG. 2B, an optional guide 27 is provided to keep the bellows portion 25 from pivoting inward toward the stick product. The guide 27 extends upwardly from the internal wall 23 of the holder cup 20 and abuts the bellows portion 25 so as to block the bellows from pivoting inward and damaging the stick product.

Figure 3C:
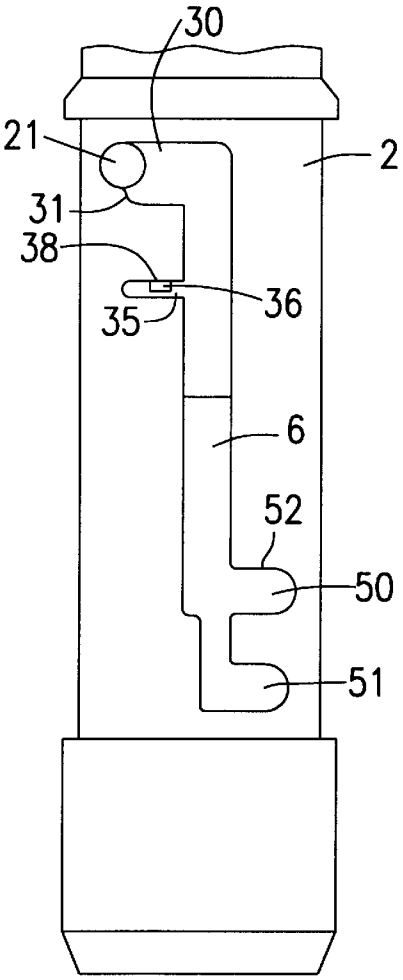
FIGS. 3A through 3C show the inner sleeve and holder cup of the present invention as the holder cup is moved into the advanced position.
Figure 3B:
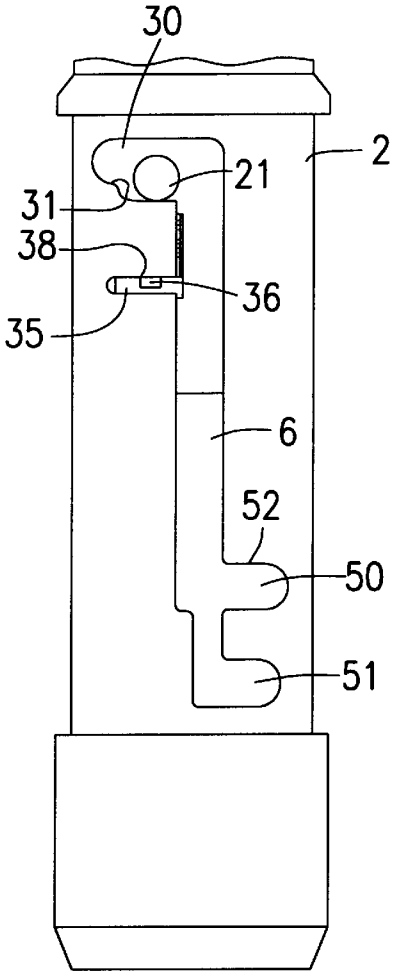
Figure 3A:
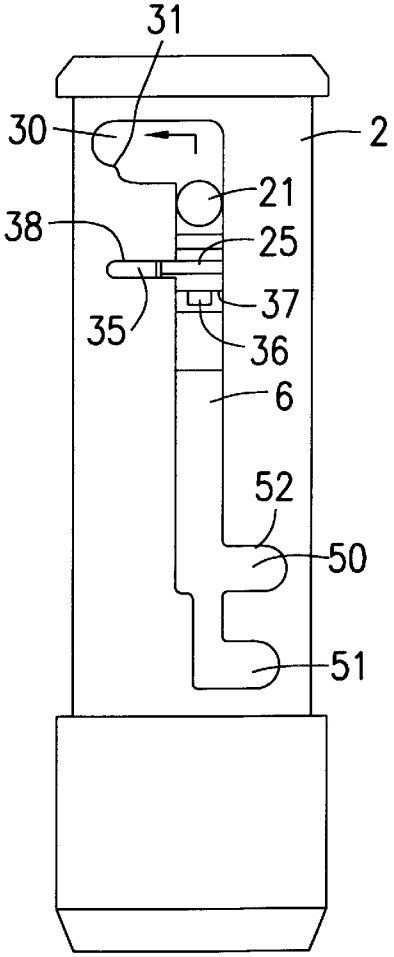

FIGS. 3A to 3C show the progression of the holder cup 20 which places the bellows 25 in the stretched position. To place the bellows 25 in the stretched position, the longitudinal track 6 of the inner sleeve 2 is provided with a first upper lateral segment 30, and a second upper lateral segment 35. As the holder cup 20 is moved into the advanced position, the first upper lateral segment 30 engages the lug 21 of the holder cup 20, and the second upper lateral segment 35 engages a nub 36 positioned on the bottom end 37 of the bellows 25, as in FIG. 3B. The nub 36 is sized so as to fit within the longitudinal track 6 and not extend past the wall 5 of the inner sleeve 2. In other words, the nub 36 is not long enough to contact the inner wall of the outer sleeve (not shown).

The first upper lateral segment 30 is further provided with a ramp portion 31 which allows the cup 20 to be advanced an additional amount, as in FIG. 3C. The second upper lateral segment 35 is not provided with such a ramp. When the cup 20 is advanced the additional amount of the ramp 31, the nub 36 is not allowed to advance with the rest of the cup 20 because it is held in place by the topmost surface 38 of the second upper lateral segment 35. This holding of the nub 36 in one location while the cup 20 is advanced is what causes the bellows 25 to be stretched.

After the bellows 25 is stretched, the lipstick product is then placed within the holder cup 20, and the cup is retracted into the case. When the lugs 21 travel down the ramp 31 of the first upper lateral segment 30, the bellows 25 contracts and forms ridges 40 (seen in FIG. 2B) which penetrate and grip the lipstick product contained within the holder cup 20. The formation of the ridges 40 prevents the lipstick product from being easily removed from the holder cup 20. Depending on the type of product contained within the holder cup, the amount of penetration required by the ridges will vary. However, too much penetration will unnecessarily weaken the stick and possibly cause a fracture. Preferably, the ridges will penetrate the stick a maximum of about 3 millimeters.

Figure 4:
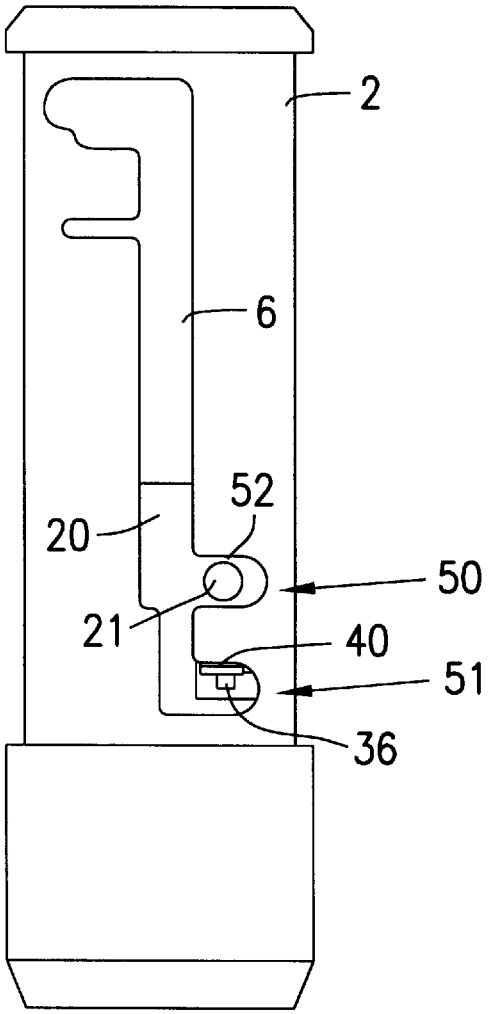
FIG. 4 shows the inner sleeve and holder cup of the present invention when the holder cup is in the retracted position.

Preferably, as seen in FIG. 4, the longitudinal track 6 on the inner sleeve 2 is provided with a first lower lateral segment 50 and a second lower lateral segment 51. These two lower segments 50 and 51 enable the holder cup 20 to be retracted into the case and remain locked in the retracted position. As the cup 20 travels down into the case, the lugs 21 and nubs 36 of the holder cup 20 align with the first lower segment 50 and the second lower segment 51 of the longitudinal track 6, respectively. With an additional slight rotation of the inner sleeve 2 and the outer sleeve 10, the lugs 21 and nubs 36 of the holder cup 20 follow the path outlined by the lower segments 50 and 51. The first lower lateral segment 50 and the second lower lateral segment 51 are spaced a distance sufficient to keep the bellows 25 in the contracted position where the ridges 40 can grip and penetrate the lipstick product. The benefit to the lower lateral segments 50 and 51 is that the holder cup 20 will be temporarily locked in place and prevented from traveling along the longitudinal track 6 when the case is inverted. For example, when the case is inverted, the lugs 21 of the holder cup 20 will contact the topmost surface 52 of the first lower lateral segment 50, thus preventing the holder cup 20 from traveling along the length of the longitudinal track 6 under its own weight, or under its own impetus after the case has been dropped.

The choice of materials for the holder cup will be guided initially by compatibility with the intended stick product and ease of manufacture for the material chosen. Possible materials for use include polyethylene, polypropylene, acetal, polycarbonate, polyvinylchloride, polyethylene-terephthalate, acrylonitrile-butadiene-styrene, styrene-acrylonitrile, styrene, and the like. Preferably, the material is polypropylene or acetal. Both of these materials can be easily molded in a thickness which will impart a significant amount of flexibility to the bellows. Also, both of these materials provide a high degree of chemical resistance to many products.

The invention, and its broader aspects, is not limited to the specific details shown and described; rather, various modifications will be suggested to one skilled in the art, all of which are within the scope of this invention.

What we claim is:

1. A holder cup for a stick product which comprises:

a shell having an inner surface and an outer surface;

a lug attached to the outer surface; and a bellows portion located below the lug and comprising part of the shell of the holder cup, said bellows capable of occupying a first stretched position and a second contracted position.

2. The holder cup of claim 1 wherein a stick product is placed within the holder cup.

3. The holder cup of claim 2 wherein the stick product is chosen from the group consisting of lipsticks, deodorants, lip balms, make-up foundations, clear cosmetic sticks, anti-acne sticks, concealers, and sunscreen sticks.

4. The holder cup of claim 2 wherein the bellows portion forms ridges which grip and penetrate the stick product when in the contracted position.

5. The holder cup of claim 1 wherein the holder cup is placed within a case.

6. The holder cup of claim 5 wherein the case comprises:

an inner sleeve surrounding the holder cup, said inner sleeve having a wall and a longitudinal track within the wall, said longitudinal track having a first upper lateral segment and a second upper lateral segment, said first upper lateral segment having a ramp; and an outer sleeve fitted about the inner sleeve so as to be able to rotate with respect to the inner sleeve, said outer sleeve having an inner wall, an outer wall, and a helical track along the inner wall.

7. The holder cup of claim 6 wherein the bellows portion has a nub which engages the second upper lateral segment.

8. The holder cup of claim 6 wherein the longitudinal track has a first lower lateral segment and a second lower lateral segment.

9. The holder cup of claim 6 wherein the holder cup is movable in an axial path between an advanced and a retracted position by the relative rotation of the inner sleeve and the outer sleeve.

10. A case for a stick product which comprises:

an inner sleeve having a wall and a longitudinal track within the wall, said longitudinal track having a first upper lateral segment and a second upper lateral segment, said first upper lateral segment having a ramp;

an outer sleeve fitted about the inner sleeve so as to be able to rotate with respect to the inner sleeve, said outer sleeve having an inner wall, an outer wall, and a helical track along the inner wall;

a holder cup fitted into the inner sleeve, said holder cup comprising:

a shell having an inner surface and an outer surface;

a lug attached to the outer surface, said lug extending through the longitudinal track to engage the helical track;

a bellows portion located below the lug and comprising part of the shell of the holder cup, said bellows capable of occupying a first stretched position and a second contracted position.

11. The case of claim 10 wherein the bellows portion has a nub which engages the second upper lateral segment.

12. The case of claim 10 wherein the longitudinal track has a first lower lateral segment and a second lower lateral segment.

13. The case of claim 10 wherein a stick product is placed within the holder cup.

14. The case of claim 13 wherein the stick product is chosen from the group consisting of lipsticks, deodorants, lip balms, make-up foundations, clear cosmetic sticks, anti-acne sticks, concealers, and sunscreen sticks.

15. The case of claim 10 wherein the bellows portion forms ridges which grip and penetrate the stick product when in the contracted position.

16. The case of claim 10 wherein the holder cup is movable in an axial path between an advanced and a retracted position by the relative rotation of the inner sleeve and the outer sleeve.

17. A case for a stick product which comprises:

an inner sleeve having a wall and a longitudinal track within the wall, said longitudinal track having a first upper lateral segment, a second upper lateral segment, a first lower lateral segment, and a second lower lateral segment, said first upper lateral segment having a ramp;

an outer sleeve fitted about the inner sleeve so as to be able to rotate with respect to the inner sleeve, said outer sleeve having an inner wall, an outer wall, and a helical track along the inner wall;

a holder cup fitted into the inner sleeve and movable in an axial path between an advanced and a retracted position by the relative rotation of the inner sleeve and the outer sleeve, said holder cup comprising:

a shell having an inner surface and an outer surface;

a lug attached to the outer surface, said lug extending through the longitudinal track to engage the helical track;

a bellows portion located below the lug and comprising part of the shell of the holder cup, said bellows capable of occupying a first stretched position and a second contracted position, the bellows portion forming ridges which grip and penetrate the stick product when in the contracted position;

a nub attached to the bellows portion, said nub engaging the second upper lateral segment when the holder cup is in the advanced position.

18. The case of claim 17 wherein a stick product is placed within the holder cup.

19. The case of claim 18 wherein the stick product is chosen from the group consisting of lipsticks, deodorants, lip balms, make-up foundations, clear cosmetic sticks, anti-acne sticks, concealers, and sunscreen sticks.

* * * * *